US008336135B2

(12) United States Patent
Lin et al.

(10) Patent No.: US 8,336,135 B2
(45) Date of Patent: Dec. 25, 2012

(54) JOINING DEVICE FOR RAILS OF A BABY BED

(75) Inventors: Li-Yuan Lin, Taipei (TW); Hong-Guang Wang, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 12/662,566

(22) Filed: Apr. 23, 2010

(65) Prior Publication Data

US 2010/0269256 A1 Oct. 28, 2010

(30) Foreign Application Priority Data

Apr. 24, 2009 (CN) ..... 2009 2 0150774 U

(51) Int. Cl.

| | |
|---|---|
| ***A47D 7/00*** | (2006.01) |
| ***A47C 7/00*** | (2006.01) |
| *A47D 13/06* | (2006.01) |
| *A47C 19/00* | (2006.01) |
| *A47C 23/00* | (2006.01) |

(52) U.S. Cl. ..... 5/99.1; 5/93.1; 5/93.2; 5/98.1; 5/282.1

(58) Field of Classification Search ..... 5/93.1, 5/93.2, 98.1, 99.1
See application file for complete search history.

(56) References Cited

U.S. PATENT DOCUMENTS

| | | | | |
|---|---|---|---|---|
| 5,530,977 | A * | 7/1996 | Wang | 5/99.1 |
| 5,781,944 | A * | 7/1998 | Huang | 5/99.1 |
| 7,380,311 | B2 * | 6/2008 | Chen | 16/326 |

* cited by examiner

*Primary Examiner* — Jonathan Liu
(74) *Attorney, Agent, or Firm* — Bacon & Thomas, PLLC

(57) ABSTRACT

A joining device is provided for rails of a baby bed, in which the joining connects two adjacent rail tubes of the rail, where an end of each of the rail tubes is pivotally connected to the joining device. The joining device is formed as a saddle part in a ⊓ shape having two upstanding side walls and an arched portion connected between top edges of the two side walls. The joining device further has a smooth contact face formed on each of the two sides of the arched portion and a smoothly trimmed face connected to the smooth contact face, so that the tube walls of the rail tubes are contacted with the smooth contact faces when the rail tubes are pivotally rotated close to the two sides of the arched portion.

7 Claims, 4 Drawing Sheets

JOINING DEVICE FOR RAILS OF A BABY BED

BACKGROUND OF THE INVENTION

1. Field of the Invention

The present invention relates to a joining device for a rail of a baby bed, and more particularly, to a joining device for a rail of a baby bed, which can prevent a fabric covering of a baby bed from being gripped between a rail tube and a connecting iron plate of the joining device when the bed frame of the baby bed is retracted.

2. Description of the Related Art

At present, the use of a baby bed is relatively common. FIG. 1 is a perspective view of a conventional baby bed in which a rail member 1 of the baby bed is in an extended state and covered with a fabric covering 10. FIG. 2 is a front view showing a structure of the baby bed shown in FIG. 1, in which the fabric covering 10 covered on the rail member 1 has been removed.

As shown in FIG. 1, when the baby bed is in use, the bed frame (for example, the rail member) thereof is usually covered with the fabric covering. Moreover, in current designs for most of the baby beds, considering that the bed frame may occupy a larger space when the baby bed is in use, the bed frame is often designed to be retractable so as to reduce the required space for storage and facilitate a carrying or moving operation of the baby bed. Therefore, a fixed or movable locking means (can be also referred to as "the joint") is further added to each of the base frames or the rail members of the baby bed so as to achieve the possibility for the retraction of the bed frame of the baby bed and provide the convenience in using and operating the bed frame of the baby bed, as shown in FIG. 2.

With reference to FIGS. 1 and 2, the conventional rail member 1 is generally comprised of a left rail tube 2, a right rail tube 3, a connecting iron plate 5 and a rail locking means 4. Each of the left and right rail tubes 2 and 3 is pivotally connected to two ends of the connecting iron plate 5, which are opposed to each other, and the rail locking means 4 is adapted to control the extension and retraction of the left and right rail tubes 2 and 3 with respect to the connecting iron plate 5.

With reference to FIG. 2, the rail locking means 4 of the conventional rail member 1 is mainly provided with a button 6 for retraction. When the baby bed is to be used, the rail member 1 is extended as shown in FIG. 2, and then a relative position of the extended left and right rail tubes 2, 3 and the connecting iron plate 5 are locked by the rail locking means 4 to thereby keep the rail member 1 in the extended state. If the baby bed is not used, the left and right rail tubes 2 and 3 can be folded up with respect to the connecting iron plate 5 by pressing the button 6 provided on the rail locking means 4 such that the rail member 1 gets into a retracted state to thereby maintain the rail member 1 to be retracted.

However, most of the designs for the retraction of the rail locking means 4 of the conventional baby bed are not ideal. For example, with reference to FIG. 2 and FIG. 3 which shows a partial enlarged side view of the rail locking means 4 of the conventional rail member 1, when the baby bed is to be retracted, the button 6 on the rail locking means 4 is depressed such that the locking state between the extended left and right rail tubes 2, 3 and the connecting iron plate 5 is removed so as to respectively render the left rail tubes 2 and the right rail tube 3 to be pivotally rotated upwardly with respect to connecting iron plate 5, so that the left and right rail tubes 2 and 3 are folded up to thereby implement a retraction operation of the baby bed. Moreover, the fabric covering 10 that is originally covered on the rail member 1 may become loose due to the retraction of the rail member 1, and the loose fabric covering 10 is extremely easy to drop into a space 7 between the rail tube (2 or 3) and the connecting iron plate 5 and thus gripped by the rail tube and the connecting iron plate. Further, not only because the edges of the two ends (only an edge 8 of an end of the two) of the connecting iron plate 5 joined with the left and right rail tubes 2 and 3 are each formed with a cut surface shaped when the processing of the connecting iron plate 5 is performed, but also because the bending angles at the edges of the two ends of the connecting iron plate 5 and the tube walls of the rail tubes are not matched with each other, a concentration point by the force will be generated when the connecting iron plate 5 is in contact with the rail tubes, and thus a frictional or stricken trace 9 is very easily formed on the left and right rail tubes 2 and 3. In addition, when the retraction operation of the bed frame is performed, since the bed frame is covered with the fabric covering, the loose fabric covering 10 is often gripped in between the rail tubes and the connecting iron plate. Even when the rail tubes are completely retracted (that is, the rail tubes are rotated upwardly by 90 degrees), the fabric covering 10 is often torn since it was tightly gripped in between the tube walls of the rail tubes and the shaped cut surface of the connecting iron plate.

To overcome the defects of the rail members of the conventional baby bed described above, the present invention provides an improved rail member of the conventional baby bed. In addition, such an improved rail member has the following advantages, for example, it is implemented to prevent the situation that the fabric covering is easily gripped by the rail tubes and the connecting iron plate when the retraction operation of the bed frame is performed and a safe locking and retraction of the baby bed can be achieved.

SUMMARY OF THE INVENTION

An object of the present application is to provide a joining device for the rails of a baby bed, which can effectively prevent the situation that the fabric covering is gripped by the rail tubes and the iron plate of the joining device when the retraction operation of the rail tubes is performed.

The present invention provides a joining device for the rails of a baby bed, in which said joining device is adapted for connecting two adjacent rail tubes of the rail and each of the rail tubes is pivotally connected to said joining device at a pivotally connecting location adjacent to an end of each of the rail tubes, said joining device is configured with two upstanding side walls and an arched portion connected between top edges of the two side walls such that the two side walls and the arched portion are formed as a saddle part in a ⊓-shape (a reversed U-shape), the joining device being characterized by comprising: a smooth contact face formed on each of the two sides of the arched portion; and a smoothly trimmed face connected to the smooth contact face and positioned below the arched portion, wherein tube walls of the rail tubes are contacted with the smooth contact faces when the rail tubes are pivotally rotated close to the two sides of the arched portion.

There is provided a joining device for the rails of a baby bed in accordance with the present invention, wherein an angle is formed between each of the smooth contact face and each of the top edges of the arched portion.

There is provided a joining device for the rails of a baby bed in accordance with the present invention, wherein the smooth contact face is formed with an arc surface to be matched with the tube wall of the rail tube.

There is provided a joining device for the rails of a baby bed in accordance with the present invention, wherein said angle between the smooth contact face and the top edge of the arched portion is maintained in a range between 40° to 60°.

The present invention provides a joining device for the rails of a baby bed, in which said joining device is formed as a saddle part in a ⊓-shape and characterized in that: two outer edges of an iron plate at two ends of two shorter sides of an arched portion of said joining device are processed such that they are bent downwardly so as to be formed as contact faces with a smooth arc shape, and each of the backsides of said contact faces is further subject to a trimming process so as to be formed as a smoothly trimmed face in order to prevent a possibility that a fabric covering is directly cut off or broken when the fabric covering covered on a bed frame is gripped between the rail tubes and the arched portion of said joining device, and a possibility of generating an indent due to friction or pressing since that the tube walls of said rail tubes are rammed with the two outer edges of the iron plate at the two ends of the two shorter sides of the arched portion of said joining device.

There is provided a joining device for the rails of a baby bed in accordance with the present invention, wherein considering that bending angles of the two outer edges of the iron plate at the two ends of the two shorter sides of the arched portion can be matched up with a size when the baby bed is retracted, the angles between the tube walls of said rail tubes and the top edges of the two outer sides of the iron plate at the two ends of the two shorter sides of the arched portion of said joining device are maintained in a certain range.

There is provided a joining device for the rails of a baby bed in accordance with the present invention, wherein the angles between the tube walls of said rail tubes and the top edges of the two outer sides of the iron plate at the two ends of the two shorter sides of the arched portion of said joining device are maintained in a range between 40° to 60°.

There is provided a joining device for the rails of a baby bed in accordance with the present invention, wherein the bending angles of the contact faces of the iron plate at the two ends of the two shorter sides of the arched portion can be properly adjusted in connection with the circular tube walls of the rail tubes, such that a possibility of generating a concentration point caused by the force on the grounds that the bending angles of the two edges of the iron plate at the two ends of the two shorter sides of the arched portion are not matched up with the tube walls of the rail tubes.

The present invention achieves an advantageous technical effect in that: in the joining device for the rails of a baby bed in accordance with the present invention, the joining device is provided with a smoothly trimmed face so as to further prevent a situation that when the baby bed is in use, a fabric covering is gripped between the rail tubes connected to the two sides of the joining device and the arched portion of the joining device as the rail tubes are extended to be in a horizontal state, and thus the fabric covering is cut off or broken.

BRIEF DESCRIPTION OF THE DRAWINGS

The accompanying drawings, which are incorporated in and constitute a part of this specification, illustrate a preferred embodiment of the invention and, together with a general description of the invention given above, and the detailed description of the embodiment given below, serve to explain the principle of the invention, in which.

DETAILED DESCRIPTION OF A PREFERRED EMBODIMENT

An embodiment in accordance with the present application will be described hereinafter with reference to the accompanying drawings by exemplifying an improved joining device for the rails of a baby bed.

Figure 4:
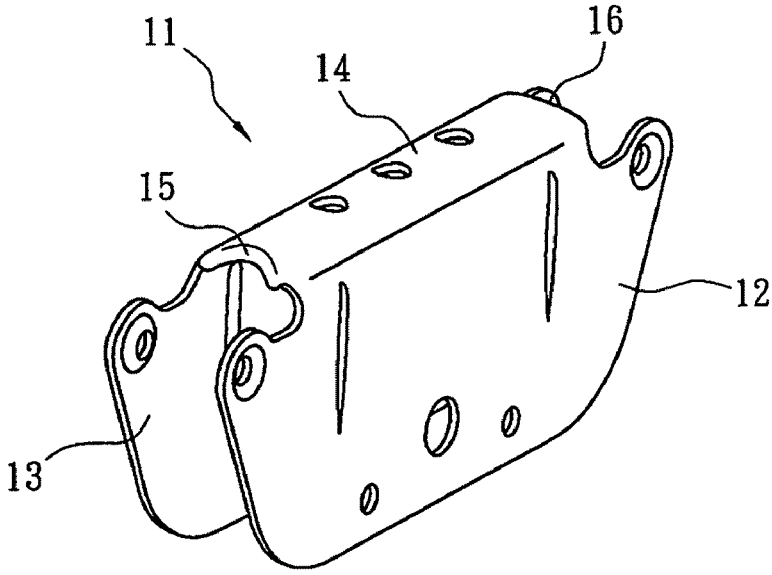
FIG. 4 is a perspective view of a joining device for the rails of a baby bed in accordance with the present application.
Figure 5:
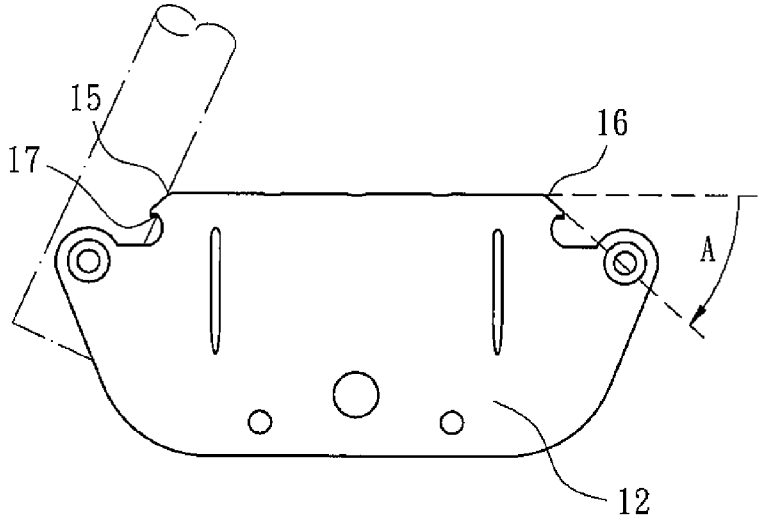
FIG. 5 is a side view of a joining device for the rails of a baby bed in accordance with the present application.
Figure 6:
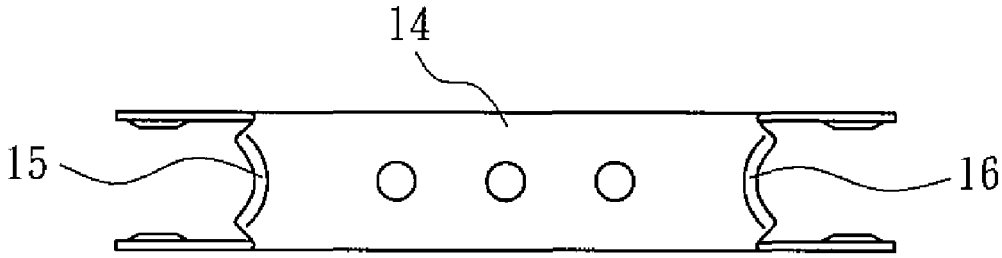
FIG. 6 is a top view of a joining device for the rails of a baby bed in accordance with the present application.

FIG. 4 is a perspective view of a joining device for the rails of a baby bed in accordance with the present application; FIG. 5 is a side view of a joining device for the rails of a baby bed in accordance with the present application; FIG. 6 is a top view of a joining device for the rails of a baby bed in accordance with the present application; and FIG. 7 is a bottom view of a joining device for the rails of a baby bed in accordance with the present application.

As shown in FIG. 4, the joining device 11 for the rails of a baby bed in accordance with the present application is, for example, made of an iron plate and integrally formed as a saddle part in a ⊓-shape (or a reversed U-shape). That is, the joining device 11 can be regarded as a ⊓-shaped saddle part formed by two side portions of upstanding side walls 12, 13 and an arched portion 14 connected between the two side walls, in which the arched portion 14 has two longer sides and two shorter sides and the two side portions of upstanding side walls 12 and 13 are respectively extended downwardly from the two longer sides of the arched portion 14 such that the contour of the joining device 11 is configured as a ⊓-shaped saddle part.

Figure 1:
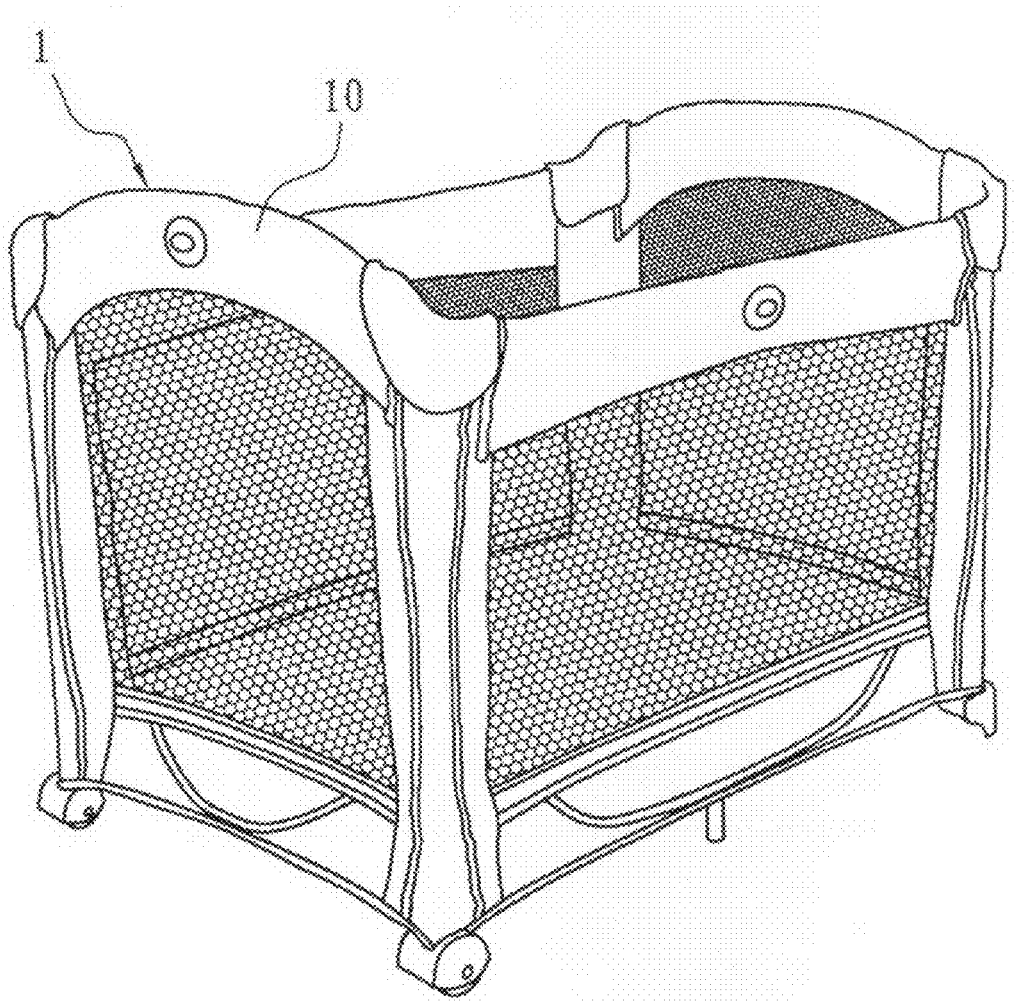
Fig. 1(Prior Art)
FIG. 1 is a perspective view of a conventional baby bed in which a rail member of the baby bed is in an extended state and covered with a fabric covering.
Figure 2:
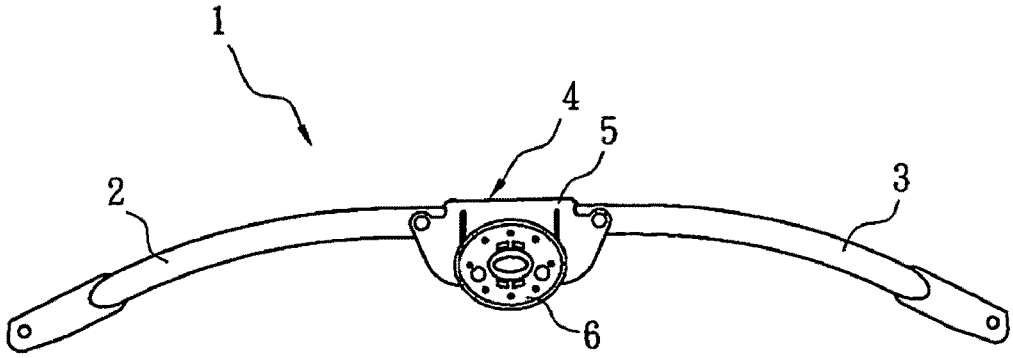
Fig. 2(Prior Art)
FIG. 2 is a front view showing a structure of the baby bed shown in FIG. 1, in which the fabric covering covered on the rail member has been removed.
Figure 3:
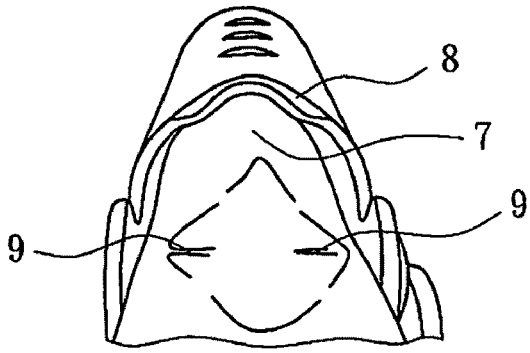
Fig. 3(Prior Art)
FIG. 3 shows a partial enlarged side view of the rail locking means of the conventional rail member.

With reference to FIGS. 4 to 7, in addition that the joining device 11 is shaped as the ⊓-shaped saddle part as described in the above, two ends of the two shorter sides of the arched portion 14 of the joining device 11 are further processed such that two edges of the iron plate at the two ends of the two shorter sides of the arched portion 14 are bent downwardly so as to make them to be formed as smooth contact faces 15 and 16. By using such smooth contact faces 15 and 16 as portions for contacting the joining device 11 with the rail tubes or the fabric covering, the possibility that the fabric covering is directly cut off or broken when the fabric covering covered on the bed frame (can be seen in FIG. 1) is gripped between the rail tubes and the arched portion 14 of the joining device 11. That is, the two edges of the iron plate at the two ends of the two shorter sides of the arched portion 14 of the joining device 11 have been subject to a process of preventing the fabric covering from being gripped between the rail tubes and the arched portion 14 of the joining device 11.

Figure 5A:
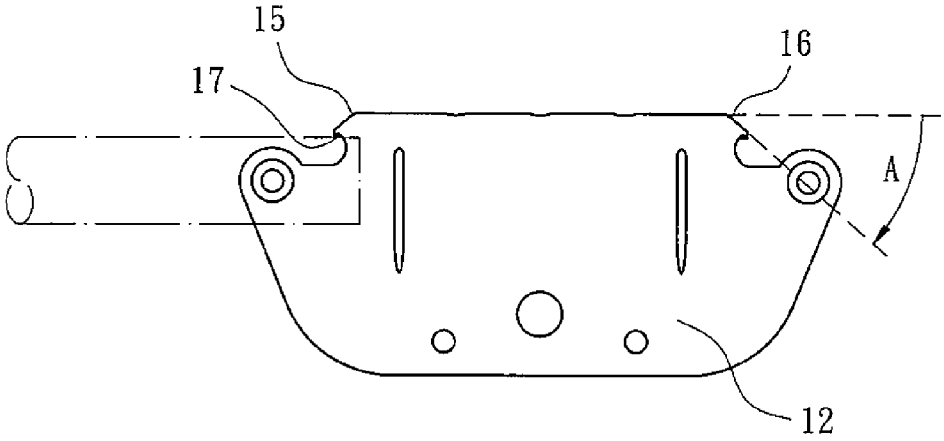
FIG. 5A is a side view of a joining device for the rails with the rails extended in a horizontal state.
Figure 7:
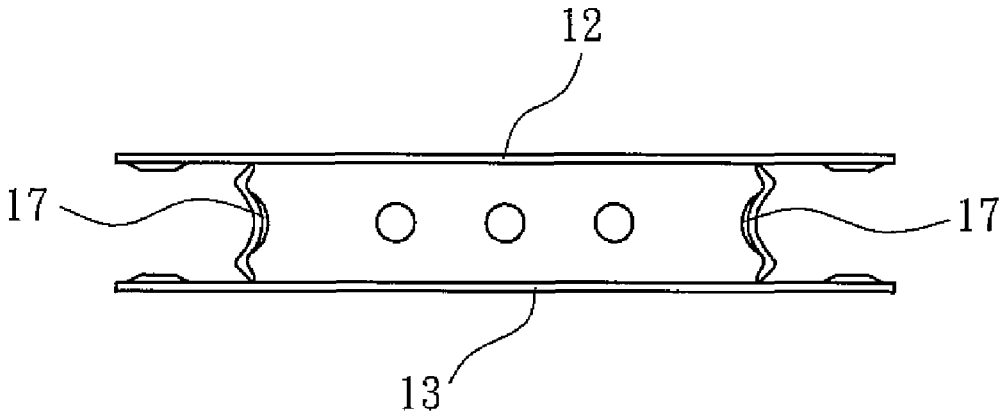
FIG. 7 is bottom view of a joining device for the rails of a baby bed in accordance with the present application.

Moreover, each of the backsides of the contact faces 15 and 16 is also processed so as to be formed as a smoothly trimmed face, for example, the smoothly trimmed faces 17 as shown in FIG. 7, in order to further reduce the generation of an indent due to friction or pressing and prevent the possibility that the fabric covering is directly cut off or broken. Additionally, as seen in FIG. 5A, the smoothly trimmed faces 17 can further prevent any situation that, when the baby bed is in an use state, the fabric covering is gripped or even cut off or broken between the rail tubes connected to the two sides of the joining device 11 and the two shorter sides of the arched portion of the joining device 11 since the rail tubes are respectively extended to be in a horizontal state.

Furthermore, considering that, for example, the bending angles of the two edges of the iron plate at the two ends of the two shorter sides of the arched portion 14 can be matched up with the size of the retracted baby bed and the distance between adjacent corner holders (not shown) of the rail tubes, the angles between the rail tubes and the contact faces 15 and 16 of the iron plate at the two ends of the two shorter sides of the arched portion 14 of the joining device 11 are often adequately adjusted. For example, the top edges of the two ends of the two shorter sides of the arched portion 14 are bent downwardly such that an angle A is formed between the top edges of the arched portion 14 and the tube walls of the rail tubes, as shown in FIG. 5. In general, the degree of the angle A can be set to be larger than 15° to 20° so as to keep the adjacent rail tubes to rotate in a preferable range when the baby bed is retracted. For example, the angle between the smooth contact face and the top edge of the arched portion is maintained in a range between 40° and 60°. Of course, the degree of the angle A can be set to be not larger than 75° to 80° in order to prevent the size of the retracted baby bed to be overly large. One more advantage of this joining device is that the surface of the joining device between the contact faces (15 or 16) and the surface 17 at the two shorter sides of the arched portion 14 of the joining device 11 has a large area which can produce an effect of cushioning the support, or disperse the stress on the contact face and strengthen the joining device 11 to support the rail tube (2 or 3).

Besides, the bending angles of the contact faces (15 and 16) at the two ends of the two shorter sides of the arched portion 14 can be properly adjusted so as to fit the outlines of the tube walls of the rail tubes. This can prevent the generation of a concentration point caused by the force on the grounds that the bending angles of the two edges of the iron plate at the two ends of the two shorter sides of the arched portion 14 are not matched with the tube walls of the rail tubes, and thus an indent due to friction or pressing will not formed on the tube walls of the rail tubes.

Therefore, as compared with the conventional baby bed, the operation of the baby bed provided with the improved joining device for the rails of a baby bed in accordance with the present invention can effectively prevent the situation that the fabric covering is gripped between the rail tubes and the joining device for the rails when the rail frame of the baby bed is retracted.

While the present invention has been described in detail and pictorially in the accompanying drawings, it is not limited to such details since many changes and modifications recognizable to those skilled in the art can be made to the invention without departing from the spirit and the scope thereof.

What is claimed is:

1. A joining device for a rail of a baby bed, wherein the joining device is configured to connect two adjacent rail tubes of the rail and each of the rail tubes is pivotally connected to the joining device at a pivotally connecting location adjacent to an end of the rail tubes, said joining device comprising:

two upstanding side walls;

an arched portion having two longer sides and two shorter sides, said two longer sides connected between top edges of the two side walls forming an interior space;

a smooth contact face formed on each of said two shorter sides of the arched portion, wherein each smooth contact face forms an acute angle with respect to a horizontal plane collinear with the apex of the arched portion; and a smoothly trimmed face extending from each smooth contact face having a first end portion connected to the respective smooth contact face and a second end portion positioned underneath the respective smooth contact face along the interior space of the joining device, wherein each of the rail tubes contacts a respective smooth contact face when the rail tube is pivotally rotated against one of the two shorter sides of the arched portion.

2. A joining device for a rail of a baby bed as claimed in claim 1, wherein:

each smooth contact face is formed with an arc surface arranged to match a tube wall of a respective rail tube.

3. A joining device for a rail of a baby bed as claimed in claim 2, wherein:

each arc surface can be formed as a supporting structure in connection with the tube wall of a respective rail tube.

4. A joining device for a rail of a baby bed as claimed in claim 1, wherein:

the angle between each smooth contact face and the horizontal plane is maintained in a range between 40° and 60°.

5. A joining device for a rail of a baby bed as claimed in claim 1, wherein:

the end of each rail tube adjacent to the pivotally connecting location is exactly reached to said smoothly trimmed face when each of the rail tubes are pivotally rotated to a horizontal state.

6. A joining device for a rail of a baby bed as claimed in claim 1, wherein each smooth contact face is configured so that a respective rail tube of the rail rests against the respective smooth contact face when the rails of the baby bed are in a folded position.

7. A joining device for a rail of a baby bed as claimed in claim 1, wherein each smooth contact face is bent downwardly from a respective side of the arched portion.

* * * * *